US006726208B2

(12) United States Patent
Wilkus

(10) Patent No.: US 6,726,208 B2
(45) Date of Patent: Apr. 27, 2004

(54) STAND FOR TARGETS

(76) Inventor: Gerald A. Wilkus, 811 Calvin Pl., Bel Air, MD (US) 21014

( * ) Notice: Subject to any disclaimer, the term of this patent is extended or adjusted under 35 U.S.C. 154(b) by 0 days.

(21) Appl. No.: 10/094,704

(22) Filed: Mar. 8, 2002

(65) Prior Publication Data

US 2003/0168813 A1 Sep. 11, 2003

(51) Int. Cl.[7] ..... F41J 1/10
(52) U.S. Cl. ..... 273/407; 248/523
(58) Field of Search ..... 273/406, 407, 273/481; 248/519, 520, 523–527, 148, 149

(56) References Cited

U.S. PATENT DOCUMENTS

| | | | | | |
|---|---|---|---|---|---|
| 631,175 | A | * | 8/1899 | Parnall | 273/406 |
| 863,486 | A | * | 8/1907 | Aiken | 273/406 |
| 2,284,510 | A | | 5/1942 | Cates | 273/102 |
| 3,194,066 | A | * | 7/1965 | Schwab et al. | 273/406 |
| 3,540,729 | A | | 11/1970 | Rahberger | 273/102 |
| 3,841,631 | A | * | 10/1974 | Dolan | 473/481 |
| 4,288,080 | A | * | 9/1981 | Laporte et al. | 273/406 |
| 4,296,693 | A | | 10/1981 | Archer | 108/28 |
| 5,067,683 | A | * | 11/1991 | Wager | 273/407 |
| 5,088,680 | A | | 2/1992 | Farmer | 248/523 |
| 5,178,356 | A | | 1/1993 | Schouwey | 248/519 |
| 5,209,492 | A | | 5/1993 | Hamilton | 273/407 |
| 5,211,404 | A | * | 5/1993 | Grant | 273/407 |
| 5,598,996 | A | | 2/1997 | Rath | 248/163.1 |
| 5,632,480 | A | | 5/1997 | Davis et al. | 473/483 |
| 5,671,924 | A | | 9/1997 | Scott | 273/407 |
| 5,803,426 | A | * | 9/1998 | Hart | 248/523 |
| 5,860,654 | A | | 1/1999 | Jacobs | 273/407 |
| 5,878,518 | A | | 3/1999 | Grewe | 40/606 |
| 5,947,477 | A | * | 9/1999 | Turnipseed | 273/407 |
| 6,491,303 | B1 | * | 12/2002 | Huston | 273/407 |

* cited by examiner

*Primary Examiner*—Mark S. Graham
(74) *Attorney, Agent, or Firm*—Armstrong, Kratz, Quintos, Hanson & Brooks, LLP

(57) ABSTRACT

A stand for supporting targets which as a base, a vertical support and a holder for the targets. Weights are carried by the base. The vertical support is carried by the base and may be disposed at an angle with respect to the base. The holder is removably attached to the vertical support and may be disposed at an angle with respect thereto. Targets are removably received by the holder. The stand may be leveled to adjust for uneven surfaces on which the base is disposed. The stand is portable and easily assembled and disassembled.

2 Claims, 13 Drawing Sheets

STAND FOR TARGETS

BACKGROUND OF THE INVENTION

1. Field of the Invention

The present invention relates to a display stand and more particularly to a display stand for targets for weapons which is adjustable to compensate for use on uneven surfaces.

2. Description of the Related Art

Target stands used by persons practicing with weapons are usually homemade. These stands are usually made of wood or plastic and are held together with nails, screws, tape, staples and other means. A strong, portable, adjustable stand, able to remain upright in wind is not readily available. The inventor has been unable to find any commercial device in sporting goods stores, gun shops or the internet. It is also important to have a target stand which may be used on uneven surfaces such as frequently encountered in open fields or on locations at the base of a hill.

In U.S. Pat. No. 2,284,510 Cates discloses a target stand which is heavy and neither portable nor easily assembled. Rahberger in U.S. Pat. No. 3,540,729 discloses a collapsible rack for holding targets which is not sturdy or wind resistant. In U.S. Pat. No. 4,296,693, Archer discloses a beach umbrella support having a collapsible container that can be filled with solid or liquid materials for stability. Corner rods are provided for additional stability. Farmer, U.S. Pat. No. 5,088,680 discloses a weighted sign base for supporting real estate signs and the like. In U.S. Pat. No. 5,178,356 Schouwey discloses a multi-purpose container-shaft support assembly, wherein the container is hollow and filled with water, sand, or gravel for stability. The container has a hole through which the shaft is housed. In U.S. Pat. No. 5,209,492 Hamilton discloses a shooting target stand. Rath discloses an adjustable target stand having anchor pins in U.S. Pat. No. 5,598,996. In U.S. Pat. No. 5,632,480, Davis et al disclose a basketball goal support with a hollow weighted base and an adjustable pole. The base can be filled with water for stability. An elastomeric ring is extended around and can be positioned at an infinite number of locations along an upper tube to define the position of the upper tube with respect to the lower tube. In U.S. Pat. No. 5,671,924 Scott discloses a portable target stand which is supported by two posts which are partially inserted in the ground. In U.S. Pat. No. 5,860,654 Jacobs discloses a portable target assembly supported by two posts driven into the ground. Grewe, in U.S. Pat. No. 5,878,518, discloses a portable sign stand with an adjustable weighted base having compartments so that the liquid or solid ballast can be added to stabilize the sign in windy conditions.

However, none of these devices are commercially available and none meet the need for a portable, lightweight, rugged device able to withstand high winds and stable on an uneven surface.

BRIEF SUMMARY OF THE INVENTION

It is an object of the present invention to provide a target stand which is portable, easily assembled, able to remain upright in wind and adjustable to be used on uneven surfaces.

In accordance with the teachings of the present invention, there is disclosed a stand for supporting targets comprising a base, a vertical support attached to the base, a holder adjustably connected to the vertical support and means to adjust the stand such that the holder is aligned in a vertical plane and a horizontal plane.

In further accordance with the teachings of the present invention, there is disclosed a stand for supporting a target used with firing of weapons. The stand has a base having means therein for receiving weights to stabilize the stand on a surface. The base further has means therein to receive a vertical support. The vertical support has a desired length. A holder is adjustably connected to the vertical support at a desired height above the surface. The holder has at least one section in which the target is removably disposed. Means are provided for adjusting the stand wherein the target is aligned in a vertical plane and in a horizontal plane.

In still further accordance with the teachings of the present invention, there is disclosed a stand for supporting targets having a base having means thereon to receive weights. A vertical support is carried by the base. A holder is removably attached to the vertical support and a target is removably carried by the holder. Means are provided to level the stand on uneven surfaces. The stand is portable and quickly and easily assembled and disassembled to be carried to and from a firing range.

There is further disclosed a stand for supporting a target used with firing of weapons. The stand has a base having means therein for receiving weights to stabilize the stand on a surface. The base further has a means therein to receive a vertical support, the vertical support having a desired length. Also, means are provided for adjustably attaching a target to the vertical support.

These and other objects of the present invention will become apparent from a reading of the following specification taken in conjunction with the enclosed drawings.

DESCRIPTION OF THE PREFERRED EMBODIMENTS

Figure 1:
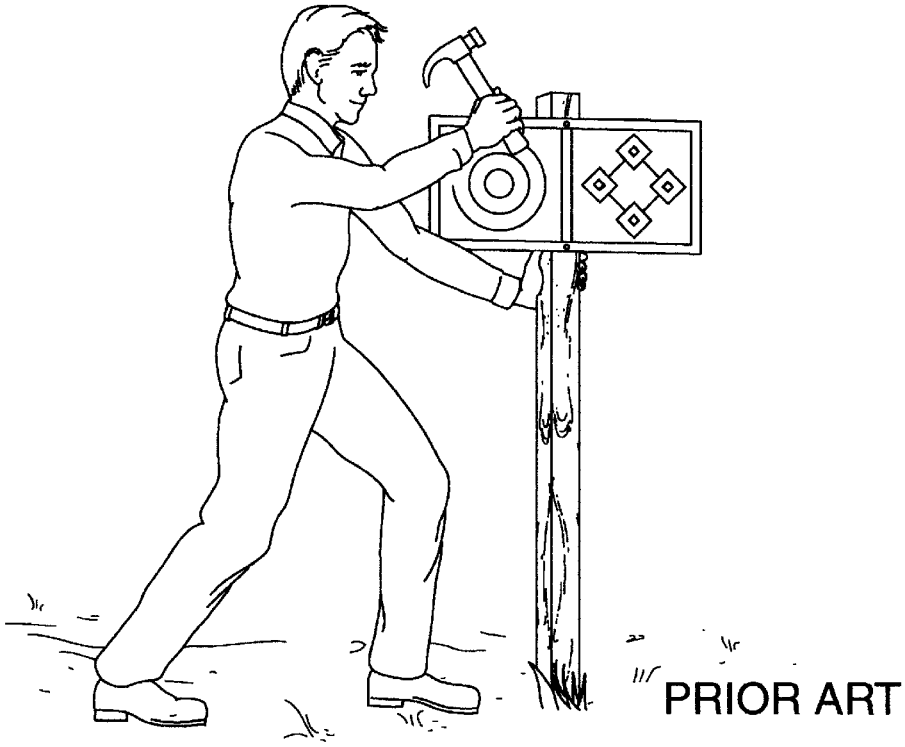
FIG. 1 is a perspective view of prior art showing a target stand being driven into the ground.
Figure 2:
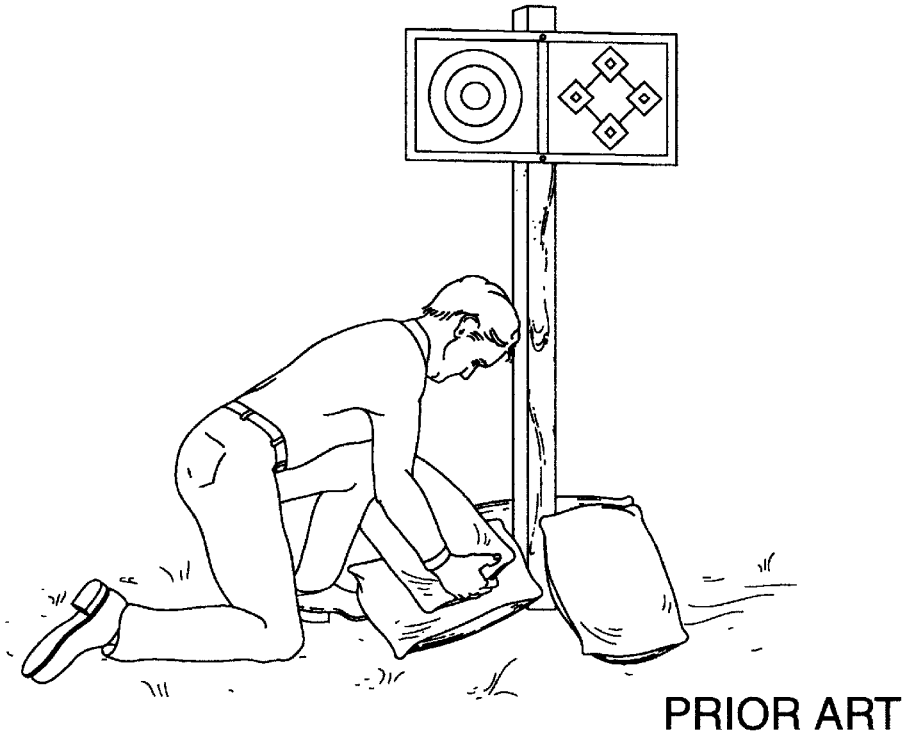
FIG. 2 is a perspective view of prior art showing sand bags being emplaced to support the target stand.
Figure 3:
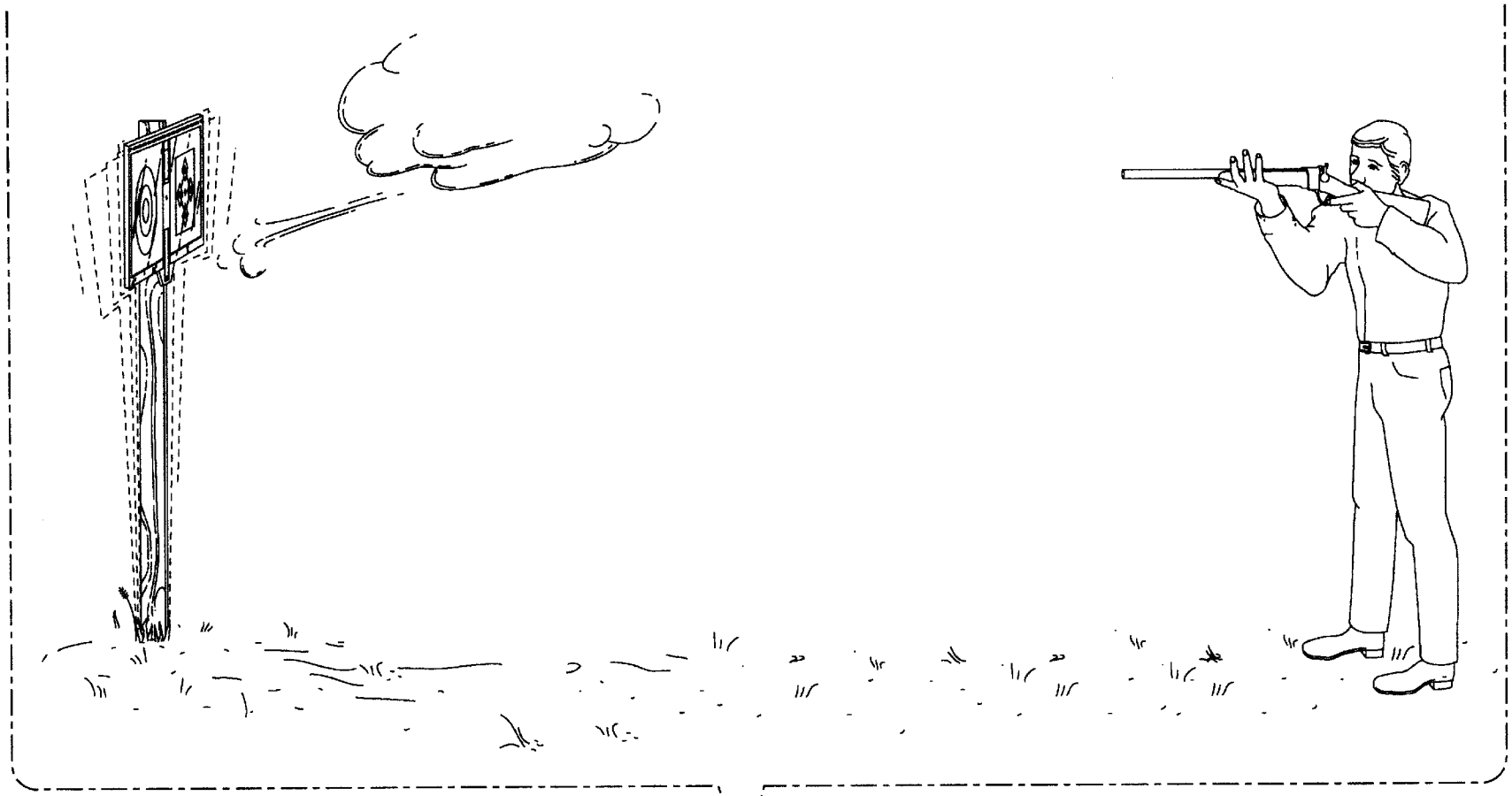
FIG. 3 is a perspective view showing a person aiming a weapon at a target stand which is moving in the wind.

Referring now to FIGS. 1–3, there is no available stand and a target is attached to a stake which is driven into the ground or is supported by sand bags or similar means. The target is not steady under wind conditions and may move when the shooter's weapon is about to be discharged. Since the terrain or surface on which the target stand is disposed is usually uneven, the target frequently is not aligned in a vertical plane and in a horizontal plane. This means that the target may be tilted to the right or the left and/or may lien toward, or away from, the shooter. The target may not be perpendicular to, and/or parallel to, the surface because the surface is uneven. It is preferred that the target be aligned in a vertical plane and a horizontal plane with respect to the horizon so the shooter always has a constant point of reference irrespective of the nature of the surface on which the stand is disposed.

Figure 4:
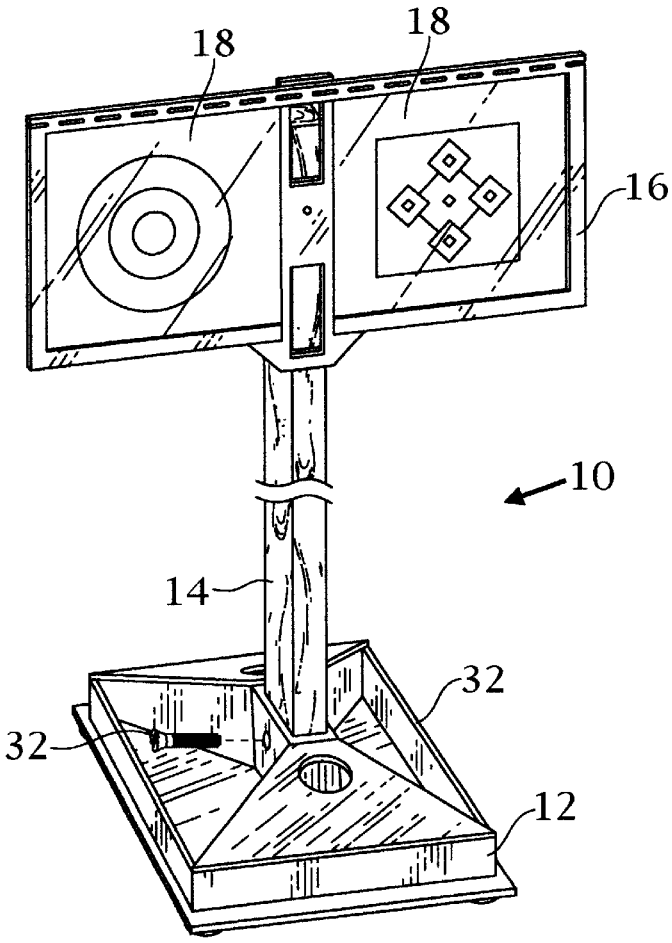
FIG. 4 is a perspective view of the stand of the present invention.
Figure 5:
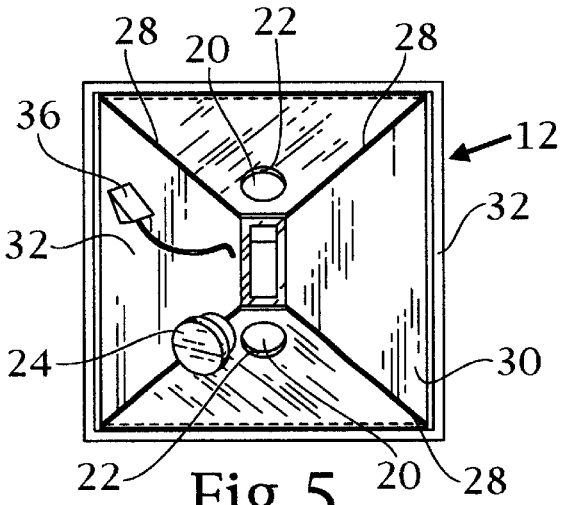
FIG. 5 is a top view of the base of the present invention.
Figure 6:
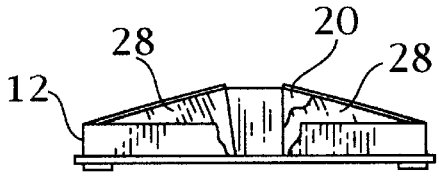
FIG. 6 is a partial cutaway side view of FIG. 5.
Figure 7:
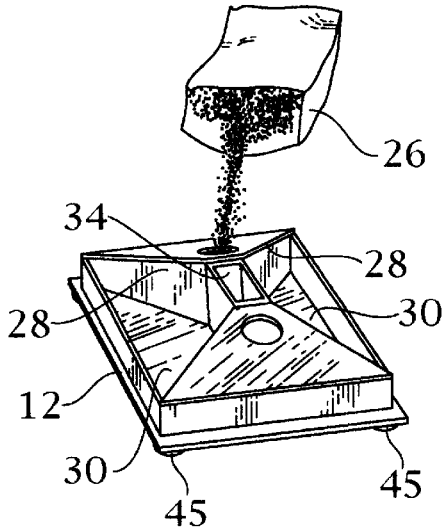
FIG. 7 is a perspective view showing the addition of gravel into the hollow portion of the base.
Figure 8:
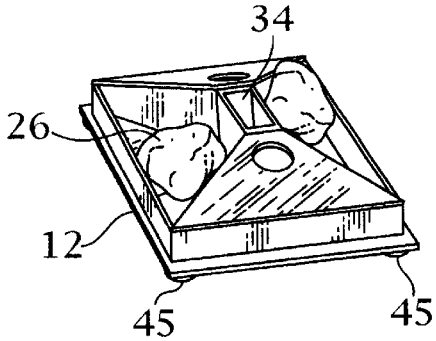
FIG. 8 is a perspective view showing stones disposed in the open compartment in the base.
Figure 9:
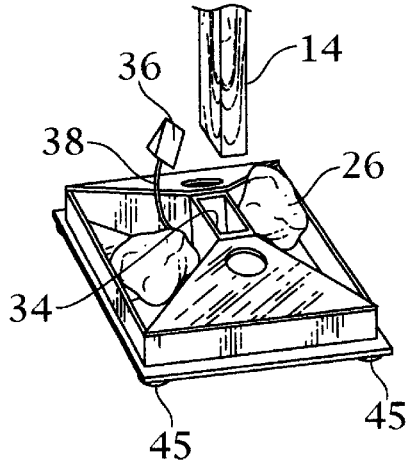
FIG. 9 is a perspective view showing the vertical support being inserted into the opening in the base and the wedge-shaped member to be disposed adjacent to the vertical support.
Figure 10:
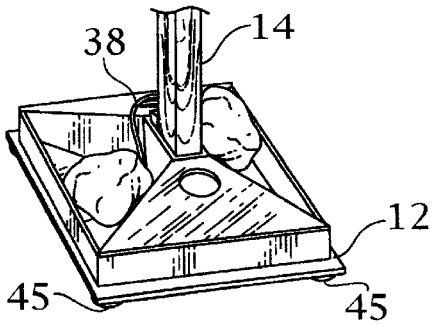
FIG. 10 is a perspective view showing the wedge-shaped member securing the vertical support in the opening in the base.

As shown in FIG. 4, the present invention is a stand 10 having a base 12, a vertical support 14 and a holder 16. Targets 18, advertisements, notices or other material may be removably disposed in the holder 16. FIGS. 5 and 6 show the base 12 which is formed in a size, shape and from material to provide stability. Weight material can be added to the base very easily under outdoor or indoor conditions. Preferably, at least one hollow portion 20 is formed in the base 12 although a hollow portion is not essential. An opening 22 is formed in the base 20 providing access to the hollow portion 20. A cap 24 is provided to close the opening 22 if desired. Material 26 such as sand, pea gravel, water, etc. can be poured onto the hollow portion(s) 20 through the opening 22 (FIG. 7). These materials 20 serve as a ballast to weight the base 12 and improve the stability of the stand 10. The base 12 may have side braces 28 to strengthen the base 12 and create compartments 30. The side braces 28 may serve as a wall forming the hollow portion 20. The compartments 30 may be used to place rocks, bricks or other suitable material 26 to serve as a weight to add stability to the base 12 (FIGS. 8, 9). A railing 32 on the compartments 30 adds strength to the base 12 and assists in retaining weight material in the compartment 30. The railing 32 may also serve as a handle for ease of carrying of the base 12.

At least one opening or boot 34 is formed in the base 12. The boot 34 preferably is elongated being wider at the top and being narrower at the bottom. The boot 34 may have any desired geometric shape (square, rectangular, circular, oval, angled, etc.). The vertical support 14 has a corresponding geometric shape but preferably is uniform and does not taper. The vertical support 14 has a selected length such that the holder 16 may be moved vertically to a desired height from the base. The end of the vertical support 14 is received in the boot 34. A wedge-shaped member 36 is provided, preferably connected to the base 12 by a flexible lead 38. The wedge-shaped member 36 is disposed in the boot 34 adjacent to the end of the vertical support 14 and may be on either side of the vertical support. In this manner, the vertical support 14 may be secured in the base 12 at an angle other than 90°. The angle may be varied to compensate for an uneven surface on which the base may be resting. By providing this angle adjustment feature, the holder 16 and the target 18 may be aligned in the horizontal plane and the vertical plane.

Another means for securing the vertical support 14 in the boot 14 is by a bolt or a pin 39 inserted in a hole formed horizontally in the boot 34 and passing transversely through an aligned hole in the lower portion of the support 14 (FIG. 4).

Figure 11:
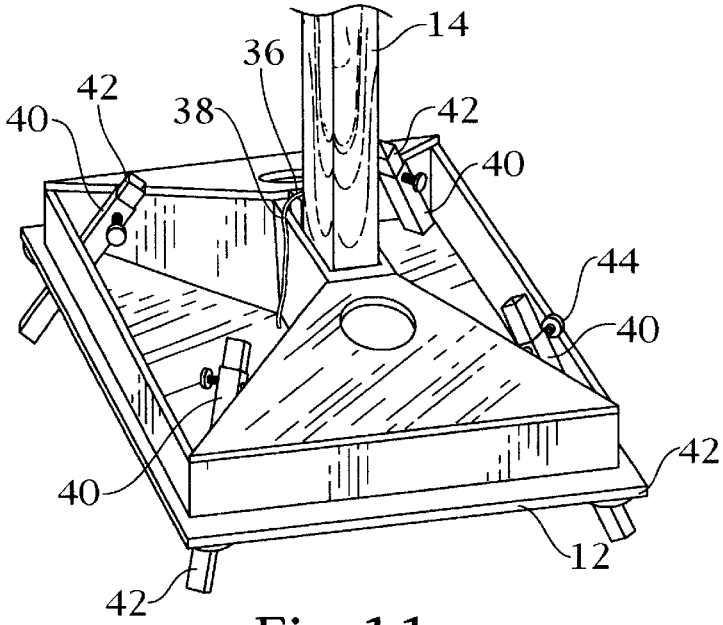
FIG. 11 is a perspective view showing channels in the base and legs adjustably received in the channels.
Figure 12:
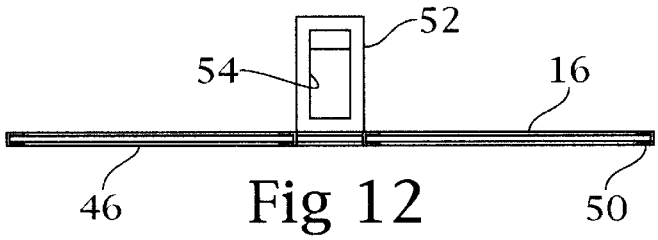
FIG. 12 is a top plan view of the holder.
Figure 13:
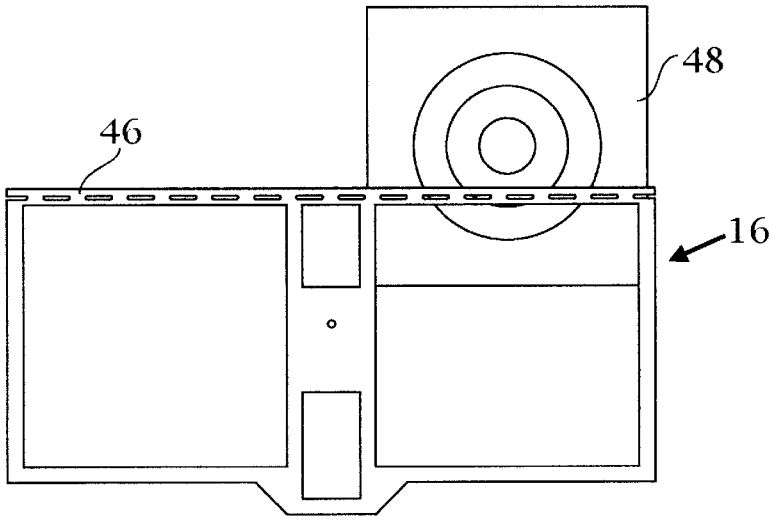
FIG. 13 is a front elevation view of the holder.
Figure 14:
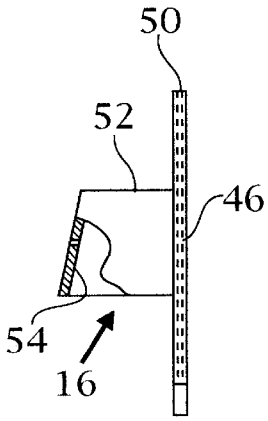
FIG. 14 is a partial cutaway side elevation view of the holder.
Figure 15:
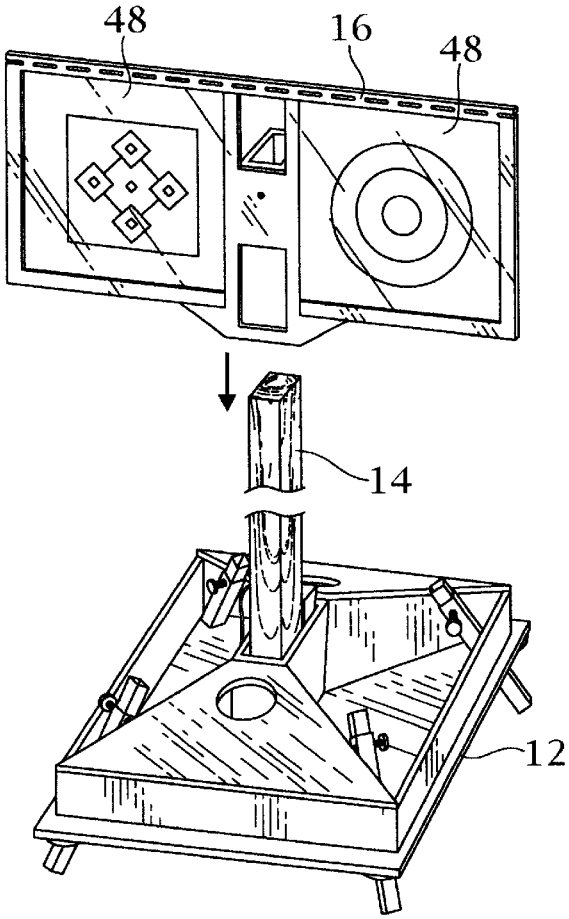
FIG. 15 is a perspective view showing the holder being disposed on the vertical support.

As shown in FIG. 11, an alternate means to provide a leveling means for the base 12, and to align the holder 16 in the horizontal plane and the vertical plane, is by means of channels 40 formed in the base 12. Preferably four channels 40 are formed in each corner at an angle with respect to the base 12. However, the channels 40 need not be at an angle with respect to the base 12. The channels 40 may also be formed on the exterior of the base 12. The channels 40 extend through the base 12. A leg 42 is disposed in each channel 40, each leg 42 being longer than the respective channel 40 so that each leg 42 may slide within the respective channel 40 and extend outside the base 12 by a desired length. Each leg 42 may be secured at the selected position by a securing means 44 such as a set screw, wing bolt or other means known to persons skilled in the art. In this manner each leg 42 is individually adjustable to extend downwardly from the base 12 by a desired length in order to level the base 12 or otherwise adjust the holder to be aligned in a horizontal plane and in a vertical plane.

The base 12 may be leveled by adjustable feet 45 connected to the underside of the base 12 as may be known to persons skilled in the art (FIGS. 7–10).

Figure 16:
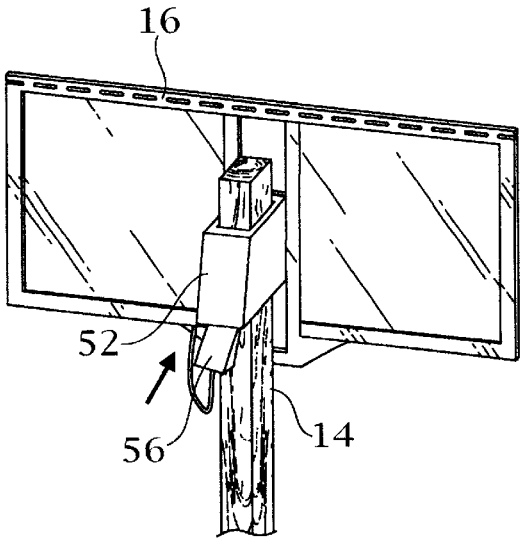
FIG. 16 is a perspective view showing a wedge-shaped member disposed adjacent to the vertical support.
Figure 17:
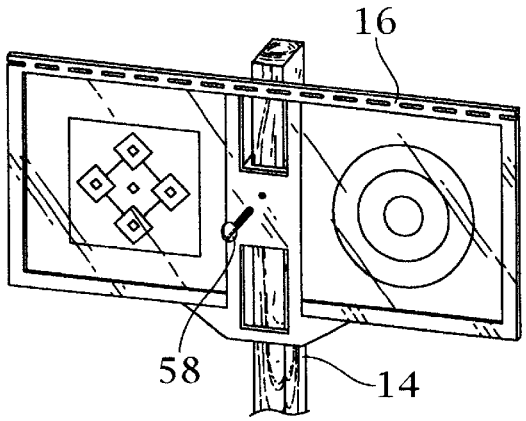
FIG. 17 is a perspective view showing a fastener securing the holder to the vertical support.

The holder 16 (FIGS. 12–17) has a frame 46 which has at least one section into which at least one panel 48 is removably received. The section preferably has spaced-apart top, side and bottom members forming a track 50 to receive the edges of the panel 48 which is slid into the track 50. The frame 46 is connected to a sleeve 52 which has a vertical opening 54 therein. The vertical support 14 is received in the opening 54 so that the holder 16 may be disposed at a selected position or angle on the vertical support 14 with respect to the base 12. The vertical opening 54 preferably is wider at the bottom than at the top. The more narrow dimension is slightly larger than the cross section of the vertical support 14 so that the holder 16 may be changed in height and in angular disposition with respect to the vertical support 14. The holder 16 may be secured to the vertical support 14 at a selected position by use of a securing means known to persons skilled in the art. As shown in FIG. 16, one example of the securing means is a wedge 56 inserted in the wider dimension of the sleeve between the sleeve 52 and the vertical support 14. To prevent loss of the wedge 56, a flexible lead connects the wedge 56 to either the holder 16, the vertical support 14 or the base 12. The weight of the holder 16 wedges the holder against the wedge and the vertical support. Another example of a securing means, shown in FIG. 17, is a bolt or similar fastener inserted in a hole in the holder 16 and tightened against the vertical support 14.

Figure 18:
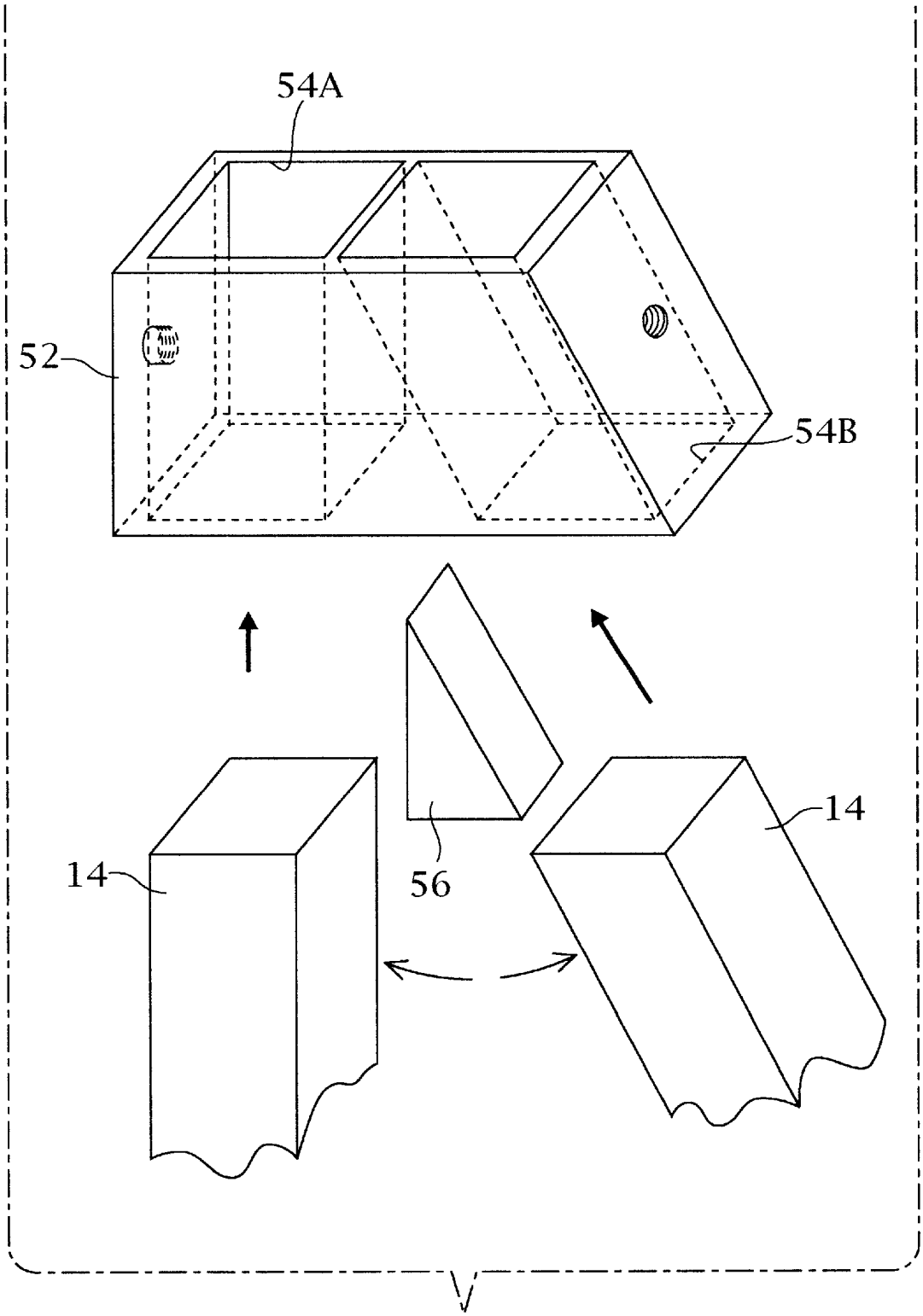
FIG. 18 is a perspective view showing the sleeve on the holder having two openings therein into which the vertical support may be received.

In still another embodiment (FIG. 18), the sleeve 52 on the holder 16 is formed having two separate openings 54A, 54B. A first opening 54A is substantially vertically aligned and the second opening 54B is disposed at an angle with respect to the first through opening 54A. This provides a means to mount the sleeve 52 of the holder 16 either parallel to or at an angle with respect to the vertical support 14 as determined by the nature or unevenness of the surface on which the base 12 rests. The wedge 56 may be disposed in either opening 54A, 54B. Alternately, the sleeve 52 may have a closed top so that the opening 54A, 54B is not a through opening and the holder 16 may not be vertically positioned on the vertical support 12.

Figure 19:
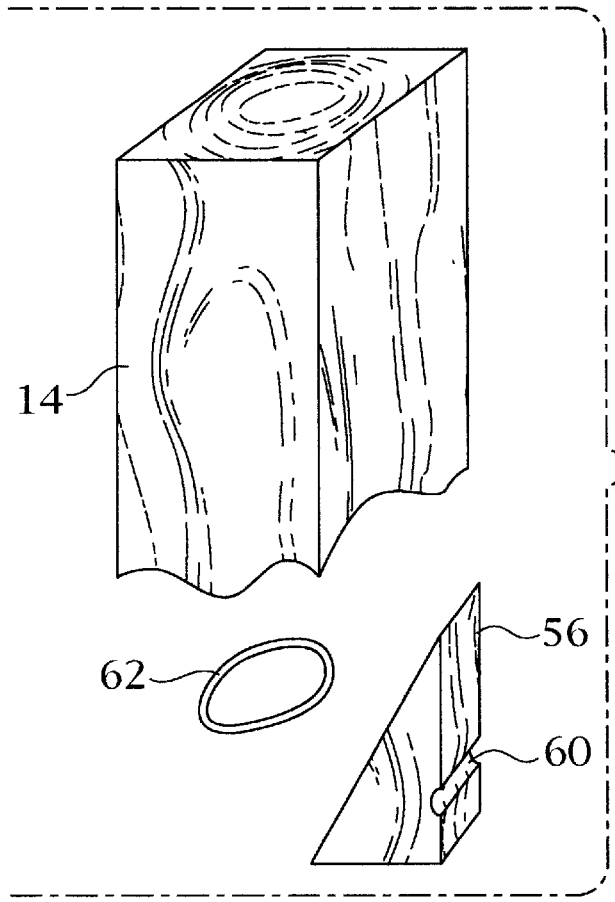
FIG. 19 is an exploded view showing the wedge, a resilient means and the vertical support.
Figure 20:
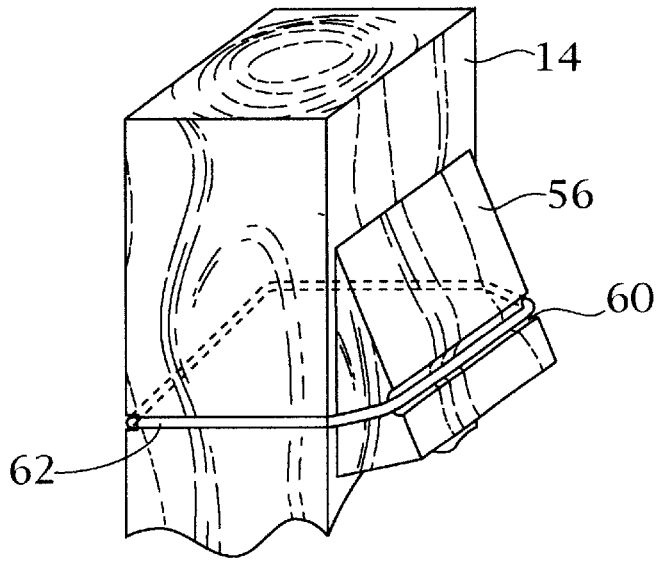
FIG. 20 is a perspective view showing the wedge connected to the vertical support by the resilient means.
Figure 21:
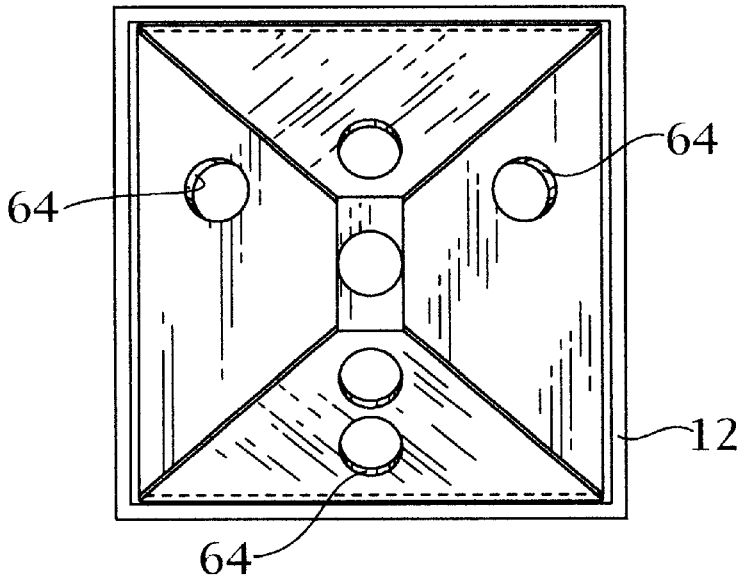
FIG. 21 is a top plan view showing a plurality of openings in which the vertical support may be received.
Figure 22:
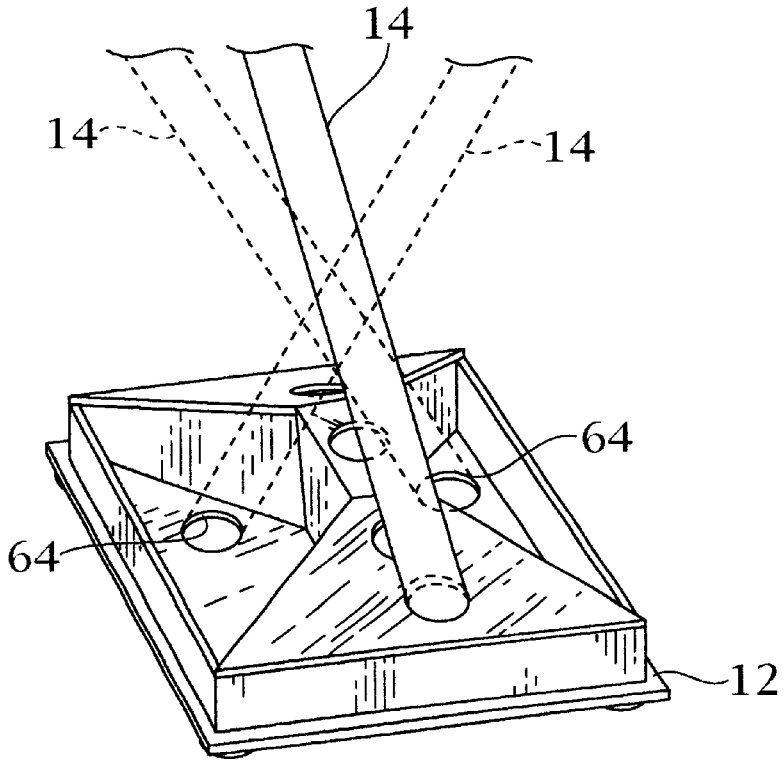
FIG. 22 is a perspective view showing the vertical support disposed in one of the openings with broken lines showing the vertical support being disposed in alternate openings.

In still another embodiment, as shown in FIGS. 19 and 20, the wedge 56 has a groove 60 formed in the thicker portion of the wedge. A resilient means 62 such as an O-ring, a rubber band, an elastic strap or similar device is disposed in the groove 60 and around the wedge 56 and vertical support 14. This provides an ability to move the wedge 56 to a desired position and to dispose the holder 16 anywhere along the length of the vertical support 14 by supporting the holder 16 on the adjustable wedge 56.

Figure 23:
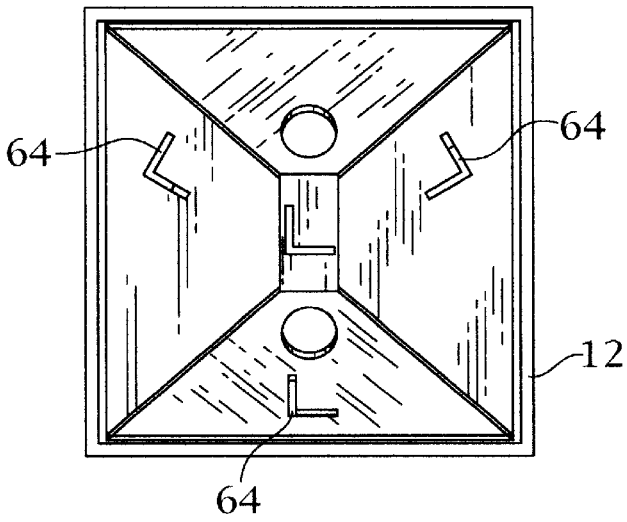
FIG. 23 is a top plan view showing a plurality of angle-shaped openings formed in the base.
Figure 24:
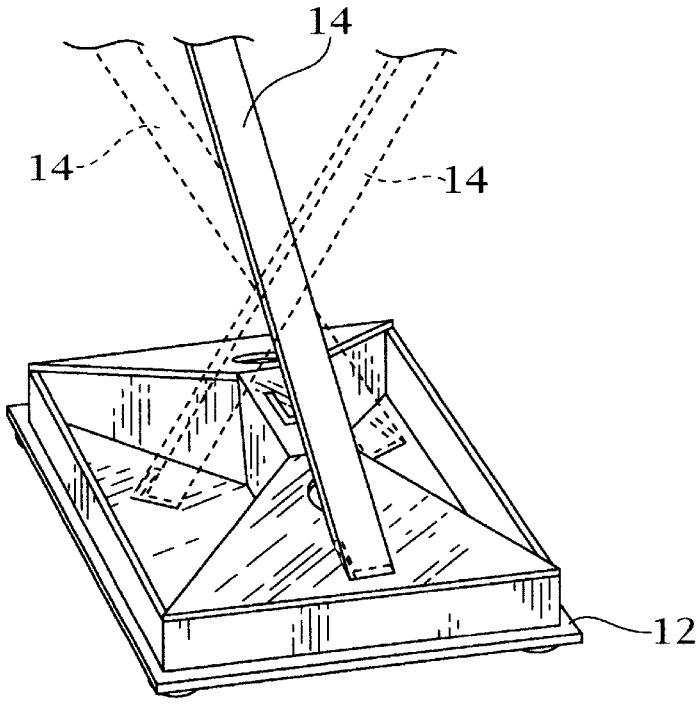
FIG. 24 is a perspective view showing a vertical support having a right angle shape received in one of the angle-shaped openings in the base with broken lines showing the vertical support in alternate openings.

For use on uneven surfaces, the base 12 may have at least one opening 64 formed at an angle with respect to the bottom plane of the base 12. If desired, a plurality of openings 14 may be formed, each at a different angle with respect to the bottom plane of the base 12 (FIGS. 21–24). The vertical support 14 is placed in the selected angled opening 64 which compensates for the unevenness of the surface on which the base is disposed. In this manner, the holder 16 is aligned in a horizontal plane and in a vertical plane. The vertical support 14 may have any of the previously described configurations. FIGS. 23 and 24 show the openings 64 in the base 12 being in the shape of right angles and the vertical support 14 having a right angle configuration.

Figure 25:
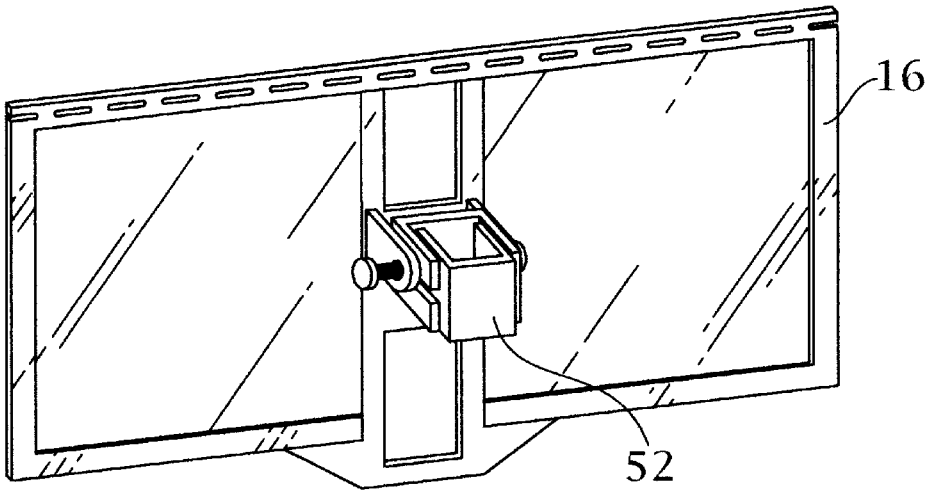
FIG. 25 is a perspective view showing an adjustable receiving means on the holder.
Figure 26:
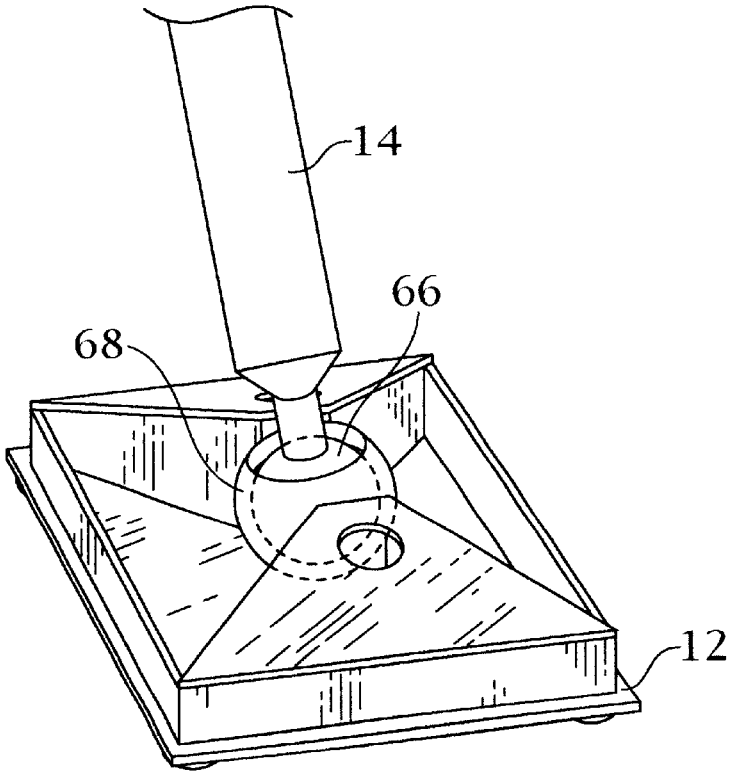
FIG. 26 is a perspective view showing a ball and socket swivel means in the base connected to the vertical support.

FIG. 25 shows an adjustable receiving means or sleeve 52 on the holder 16. The sleeve 52 may be moved to a selected angle with respect to the vertical plane of the holder and may be secured in the selected angle by a locking means such as an adjustable screw. This structure provides a means to adjust the angular disposition of the vertical support with respect to the vertical plane of the holder 16 and to compensate for unevenness of the surface on which the base 12 of the stand 10 is disposed.

A socket 68 may be formed on the base 12 and the lower end of the vertical support 14 may have a ball 66 formed thereon. Alternately, the ball 66 may be formed on the base 12 and the socket 65 may be formed on the lower end of the vertical support 14. The ball 66 is received cooperatively in the socket 68. The vertical support 14 may be moved to any selected angular displacement with respect to the base 12 to compensate for the unevenness of the surface on which the base 12 is disposed. Means are provided to secure the ball 66 to the socket 68 at the selected angular displacement.

Figure 27:
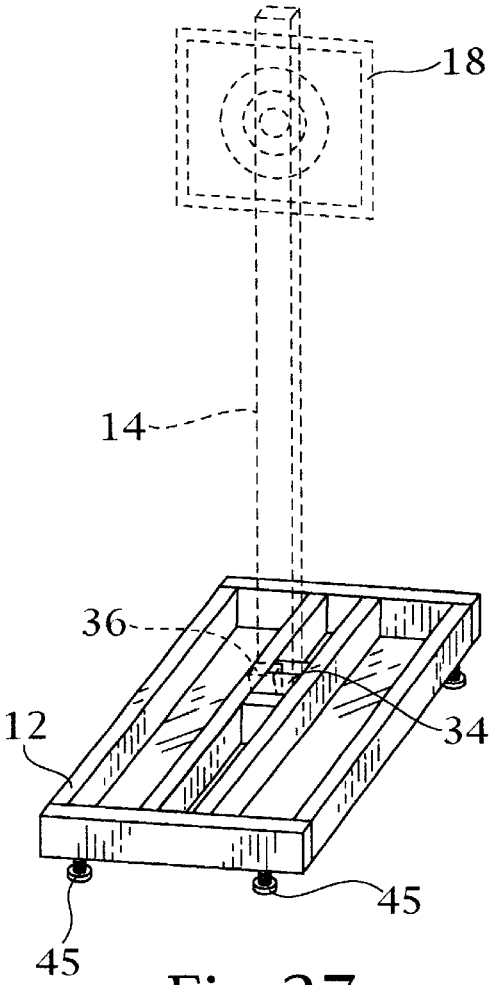
FIG. 27 is a perspective view of another embodiment of the base.

In another embodiment of the base 12 as shown in FIG. 27 a frame has a boot 34 formed in the approximate center of the frame. The vertical support 14 is disposed in the boot 34 as in the previously described embodiments with the boot 34 being slightly larger than the vertical support 14. A wedge 36 may be inserted between the boot 34 and the vertical support 14 to adjust the angular relationship between the boot 34 and the vertical support 14 as needed to compensate for an uneven surface on which the base 12 may be disposed. In this and the other embodiments the target 18 may be held in a movable holder 16 attached to the vertical support 14 or the target 18 may be directly attached to the vertical support. Means known to persons skilled in the art may be used for direct attachment of the target including, but not limited to, nails, thumb tacks, staples, adhesive-backed tape, etc. Preferably, adjustable feet 45 are connected to the lower surface of the base 12 to provide for use of the base 12 on an uneven surface.

Figure 28:
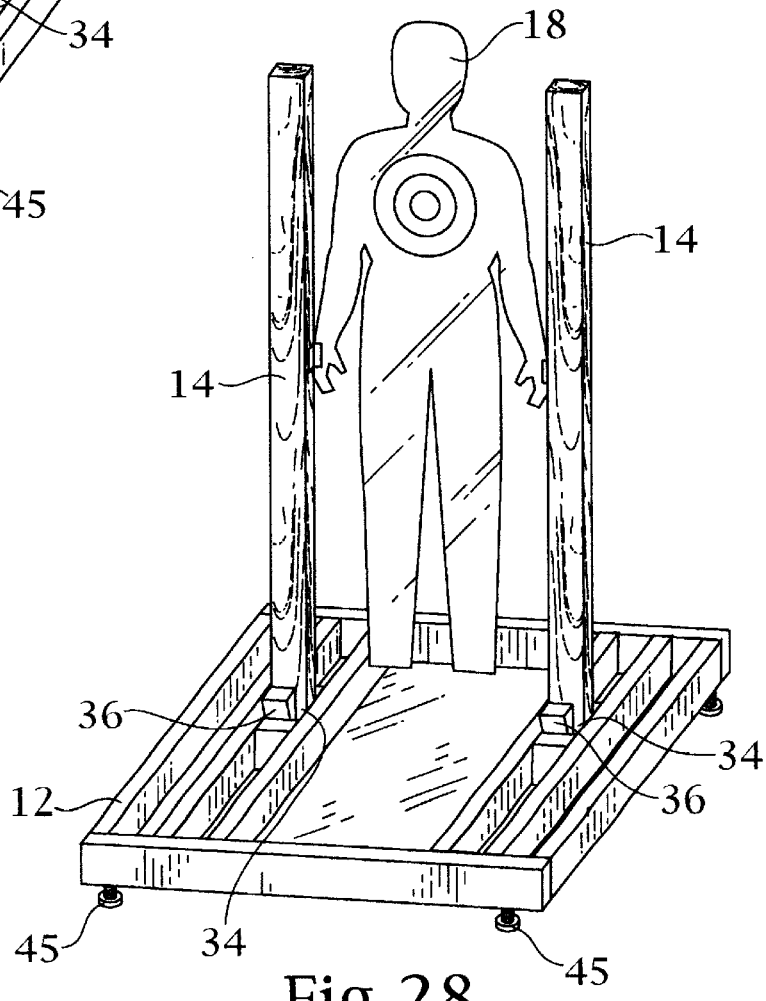
FIG. 28 is a perspective view of the embodiment of the base of FIG. 27 wherein two supports are provided for a target to be mounted therebetween.

Referring to FIG. 28, the frame has two boots 34 formed on opposite sides so that a separate vertical support 14 may be received in each boot 34. The target 18 is supported between the two vertical supports.

All of the embodiments provide a base 12 which can be used very easily with replaceable vertical supports 14 and targets 18. This recognizes that the target and the vertical supports will be damaged during use and must be replaced. The base is reusable.

Figure 29:
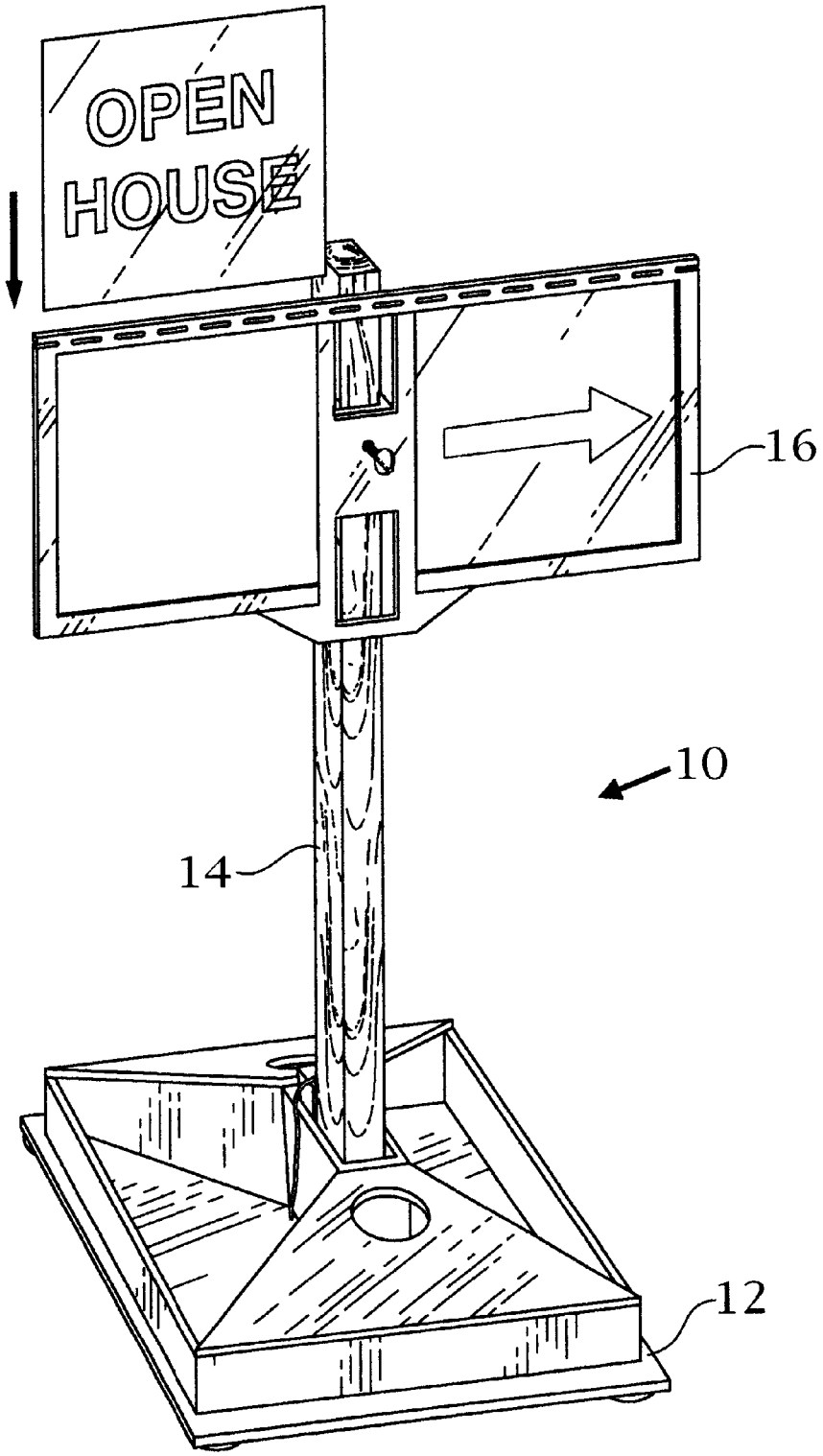
FIG. 29 is a perspective view showing the stand of the present invention having real estate advertising in the holder.

Although the present invention is described primarily for targets, it is also applicable to other uses. For example, FIG. 29 shows use of the present stand for showing of an open house for real estate. Any sign for advertising display could be placed in the holder.

The present invention provides a portable stand which is easily assembled and disassembled. It is stable under wind conditions and is easily adjusted to provide a display which is aligned in a horizontal plane and a vertical plane irrespective of the unevenness of the surface on which the base is disposed. The display, vertical support and holder are all easily and rapidly replaced which is important in situations such as target shooting when the components become damaged.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A portable knock-down stand for supporting a target comprising a base having levelers and further having at least a first boot formed therein, at least a first upright disposed in the first boot, at least a first wedge driven vertically into the first boot and between the first boot and the first upright, thereby removably retaining the first upright in the first boot, a target carried by the first upright, and the vertical disposition and the horizontal disposition of the target and the first upright being determined by the first wedge and by the levelers on the base, thereby compensating for an uneven ground surface, and further including a second boot on the base, a second upright disposed in the boot, and a second wedge driven vertically between the second boot and the second upright, said pair of first and second parallel uprights are adjustably disposed in the respective boots, such that the target is mounted between the pair of parallel uprights.

2. The portable knock-down stand of claim 1, wherein a compartment is formed in the base juxtapositioned to the at least a first boot, whereby a weight or weights may be placed in the compartment.

* * * * *